US005479790A

United States Patent [19]

Bottum, Jr. et al.

[11] Patent Number: 5,479,790

[45] Date of Patent: Jan. 2, 1996

[54] SUCTION ACCUMULATOR STRUCTURE

[76] Inventors: Edward W. Bottum, Jr.; Edward W. Bottum, Sr., both of c/o Refrigeration Research, Inc., 525 N. Fifth St., Brighton, Mich. 48116

[21] Appl. No.: 86,307

[22] Filed: Jul. 6, 1993

[51] Int. Cl.[6] ..... F25B 43/00

[52] U.S. Cl. ..... 62/503; 62/513; 220/420

[58] Field of Search ..... 62/503, 509, 513; 220/420, 425

[56] References Cited

U.S. PATENT DOCUMENTS

| | | | |
|---|---|---|---|
| 3,212,289 | 10/1965 | Bottum | 62/468 |
| 3,295,709 | 1/1967 | Herrick et al. | 220/9 |
| 3,355,045 | 11/1967 | Douglas | 215/13 |
| 3,643,465 | 2/1972 | Bottum | 62/503 |
| 4,595,437 | 6/1986 | Yamamoto | 156/87 |
| 4,680,935 | 7/1987 | Murai | 62/45 |
| 4,850,496 | 7/1989 | Rudell et al. | 215/12.1 |
| 5,167,128 | 12/1992 | Bottum | 62/174 |

*Primary Examiner*—William E. Tapoical
*Attorney, Agent, or Firm*—Howard & Howard

[57] ABSTRACT

The present invention is directed to a suction accumulator construction comprised of a pair of closed vessels arranged in spaced relation one within the other to define an air or vacuum space therebetween effective to prevent sweating of the inner vessel during performance of its normal suction accumulator function. The air space may be evacuated to near vacuum to improve upon the sweating-avoidance function. Further, air spaces may be provided around the ends of the inlet and outlet tubes to and from the suction accumulator to preclude sweating or frosting thereof. Means are also provided for circulating heated fluid in the space between the closed vessels.

10 Claims, 1 Drawing Sheet

SUCTION ACCUMULATOR STRUCTURE

BACKGROUND OF THE INVENTION

It is known in the art to which this invention pertains to provide a suction accumulator between the evaporator and compressor of a refrigeration system in order to protect the compressor from possible damage. Vaporized refrigerant is received from the evaporator and passed on through the suction accumulator to the compressor. Any raw liquid is metered back to the compressor at a rate that will not result in damage to the compressor.

In recent years, primarily for reasons of energy savings and improved efficiency, it has often become the practice to flood the evaporator, or "low side" of the refrigeration system. This causes liquid refrigerant to spill back into the suction accumulator, wherein evaporation takes place, reducing the surface temperature of the accumulator below ambient dewpoint, which causes sweating of the accumulator surfaces. Sweating of the accumulator ultimately leads to rusting, and possible accumulation of water on the floor surfaces.

One expedient which has been employed in an effort to eliminate the sweating and ultimate rusting problems has been to wrap or encase the suction accumulator with one or more layers of insulation. However, this is costly from a material and labor standpoint. Also, difficulty has been encountered in providing an air-tight insulative seal, ultimately resulting in the described sweating and rusting problems.

It has further been proposed to position a suction accumulator within a receiver, and to admit into the space therebetween high temperature liquid refrigerant from the condenser. A structural arrangement of this character is shown in U.S. Pat. No. 3,212,289. As is described therein, the relatively warm refrigerant prevents moisture in the atmosphere from condensing on the accumulator which contains relatively cold refrigerant. The patented arrangement also provides an efficient heat exchange between the relatively cold low pressure refrigerant in the accumulator and the relatively warm high pressure refrigerant in the receiver.

SUMMARY OF THE INVENTION

Applicants have discovered that the provision of a dead air space between a suction accumulator and a surrounding sealed vessel or container is effective to a large degree in precluding sweating and subsequent rust formation upon the accumulator walls. The insulative property of the space provided by the novel structure of this invention may be further enhanced by evacuating the space. The structure resulting may be considered similar to that of a vacuum Thermos bottle. Additionally, enhancement of the novel purposes of this invention may be accomplished by provision of means effective to prevent sweating of the inlet and outlet connections to and from the suction accumulator.

In furtherance of the novel concepts of the present invention, applicants have found that significant advantages result by combining into a single unit a suction accumulator and receiver, or even more advantageously, a suction accumulator, receiver and heat exchanger into a unitary structure. The functions of each are achieved in a single body, and thereby the costs of each as separate units are eliminated, with the further advantage of substantial space savings.

DESCRIPTION OF A PREFERRED EMBODIMENT

Figure 1:
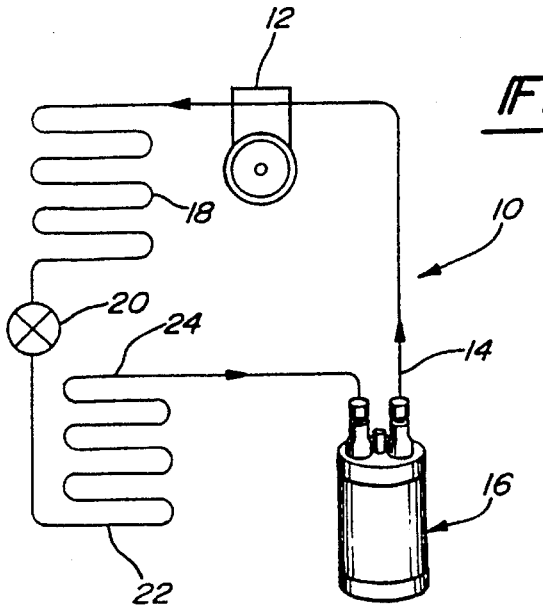
FIG. 1 is a schematic diagram of a refrigeration system representing an illustrative environment for the suction accumulator structure of this invention.

Referring now first to FIG. 1 of the drawings, a conventional refrigeration system 10 is shown, the system being charged with a refrigerant material. As is normal, compressor 12 receives gaseous refrigerant through suction conduit means 14 from suction accumulator 16, the gaseous refrigerant is compressed, and passes to condenser 18. The refrigerant is condensed to a liquid state at 18, and passes through expansion valve 20 whereat its temperature and pressure are reduced. The cooled refrigerant then passes to evaporator 22, wherein it is vaporized by absorbing heat, and then enters suction accumulator 16 through conduit means 24.

In recent years there is an increasing tendency, ascribed to energy savings and efficiency requirements, to flood the "low side" of the refrigeration system of FIG. 1, and more particularly the evaporator 22 shown therein. This causes liquid refrigerant to almost continuously spill back into the suction accumulator. Evaporation of this liquid in the accumulator reduces its surface temperature often below the ambient dewpoint, causing constant sweating of the accumulator surface. This constant sweating ultimately results in rusting of the accumulator, and further, the deposition of undesirable pools of water on floors.

Figure 2:
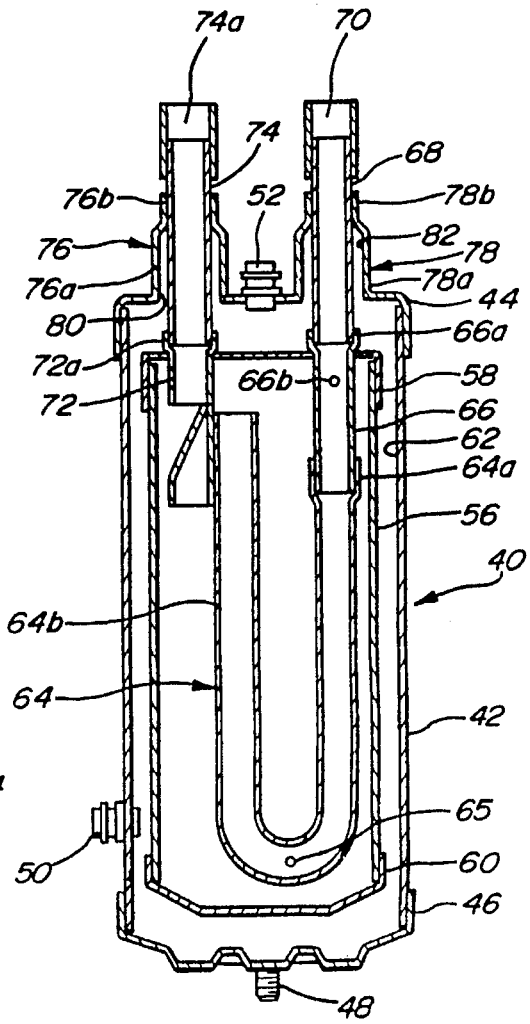
FIG. 2 is a side elevational view of a suction accumulator constructed in accordance with the novel concepts of the present invention.

Applicants have discovered that these problems are effectively overcome, and other advantageous results achieved, by utilization of a suction accumulator assembly substantially as shown in FIG. 2 of the drawings. The accumulator assembly is designated generally therein by the numeral 40, and comprises an outer generally cylindrical shell or casing 42, sealed essentially hermetically at opposite ends by cap or closure means 44 and 46. The outer shell 42 functions in the nature of a receiver in the present invention, and may support threaded mounting means 48, as is conventional in the art. Provided on outer casing or receiver 42 at any desired location thereon are a pair of passaged or open-ended connector means 50 and 52, constructed to be sealed or rendered air tight when required. The function of the connector means 50 and 52 will be set forth in detail hereinafter.

Located interiorly of the shell or casing 42 is a suction accumulator, generally designated by the numeral 54. The accumulator 54 preferably takes the form of a generally cylindrical shell 56 to which at opposite ends are welded or otherwise secured cap or closure means 58 and 60. As appears in the drawing, the outer and inner shells 42 and 56, respectively, are coaxially spaced to provide an annular space 62 for fluid, which may be vacuum, air, gas or liquid, depending upon the particular function or mode of operation of the suction accumulator assembly 40 selected, as will be more fully set forth hereinafter.

Disposed within the casing 56 of the suction accumulator 54 and suitably supported therein is a generally U-shaped outlet tube 64, which may be expanded at 64a to receive an intermediate tubular section 66 having an expanded end portion 66a connecting with outer tubular section 68. The latter tube section 68 may mount expanded quill means 70 which connects with conduit means 14 leading to compressor 12. U-tube 64 may be provided with a small metering opening 65, and in intermediate tubular section 66 an opening **66*b* is provided to equalize the pressure in the legs of the U-tube 64**.

Located in proximity to the leg portion **64*b* of the U-tube 64 is inlet tube 72, supported in any desired manner by accumulator shell 56, and being expanded as at 72*a* to connect with intermediate tubular section 74 mounting nipple portion 74*a* to which there is joined conduit means 24 leading to evaporator 22**.

Figure 3:
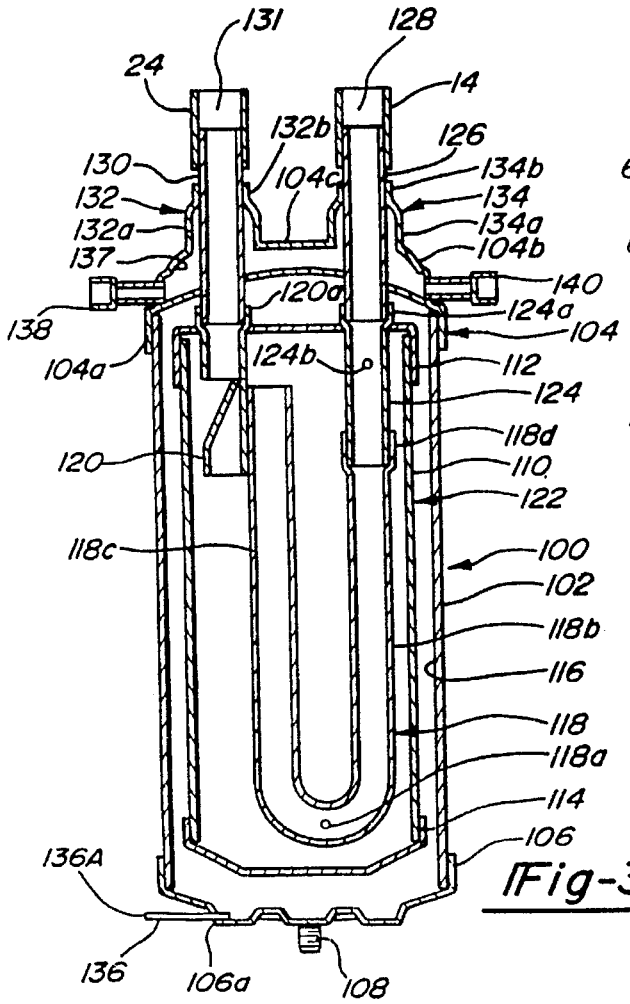
FIG. 3 is a side elevational view of a modified form of the invention.

A suction accumulator employing a U-tube as shown in FIGS. 2 and 3 of the present application drawings is shown and described in a number of issued patents, and illustrative thereof is U.S. Pat. No. 3,643,465, issued in the name of one of the present applicants. However, it should be understood that the novel concepts of the instant invention may be practiced with other accumulator constructions, as for example, that shown and described in U.S. Pat. No. 5,167,128, also issued in the name of one of the present applicants.

The suction accumulator assembly 40 as constructed and arranged in the manner shown in FIG. 2 is effective to substantially entirely avoid the sweating problem earlier described. With the assembly 40 connected and operating in a refrigeration system substantially as shown in FIG. 1, and assuming the connector means 50 and 52 are sealed and are thus air-tight, cold refrigerant vapor and slugs from evaporator 22 enter the assembly accumulator 54 at **74*a* and leave at 70. However, by provision herein of dead air space 62, an effective insulative barrier is produced and sweating of outer shell 42** is prevented.

By this invention, an insulative space is also provided surrounding each of the inlet and outlets to the suction accumulator 54. Referring again to FIG. 2 of the drawings, cap or closure means 44 is formed or otherwise provided with a pair of upstanding or protruding tubular portions 76 and 78, each having a relatively large diameter body section **76*a* and 78*a* and reduced diameter neck section 76*b* and 78*b*, respectively. The tubular portions as so formed and positioned relative to the inlet 74*a* and outlet 70 provide annular air spaces 80 and 82 surrounding the tubular portions 74 and 68, respectively. In this manner, sweating does not occur upon the relatively cold tubular portions at their locations of entry into and exit from the outer shell 42. The tubular portions 76 and 78 may be steel or copper, and at present copper is preferred. The portions 76 and 78 may be integrated with the cap means 44, or may be provided as separate fittings secured thereto. Also, the tubular members 74 and 68** may be copper.

Under some operating conditions, a dead air space within the cavity 62 provides adequate insulation against sweating. However, an improved insulating effect will be achieved by evacuating the air space to a condition in the space in which the pressure of the air is significantly less than that of the normal atmosphere surrounding the vessel 54. Either of the connector means 50 or 52 may be utilized for drawing vacuum, and of course, the particular connection employed is immediately thereafter sealed.

The suction accumulator assembly 40 of this invention not only has significant utility in the prevention of sweating upon the outer vessel 42; however, without the necessity of substantial modification thereto, a dual function of suction accumulator and heat exchanger may be provided. In this event, the previously described connections from the inlet **74*a* to the evaporator 22 and from the outlet 70 to the compressor 12 are made. In addition, in order to achieve an accumulator-heat exchanger dual function, warm liquid from condenser 18 is routed by suitable conduit means (not shown) to connector means 52, and another connection (not shown) made from expansion valve 20 to connector means 50. In this manner, warm liquid from the condenser 18 substantially fills the cavity 62, and the subcooled liquid passes through connector means 52 to the expansion valve 20**. Effective heat exchange is thereby accomplished, in addition to preventing sweating, and significant space savings are achieved by eliminating the need for a separate heat exchange unit.

A further feature of the present invention is its capability to function as a receiver, in addition to the described dual function of suction accumulator and heat exchanger. As is known, one function of a receiver is to provide for a fluctuation of charge during operation of the refrigeration system. Accordingly, in order for the apparatus 40 of FIG. 1 to also function as a receiver, it is only necessary that the liquid charge from the condenser which feeds into the space 62 be reduced, so as to provide some gas volume on the top thereof. If necessary, the volume between the containers 42 and 56 may in some convenient manner be increased to aid the receiver function.

Depending upon the particular refrigeration system employed, there may be encountered conditions under which prevention of sweating or frosting of the suction accumulator is required, and yet lesser heat exchange may be indicated. Illustrative of such systems are those using a suction cooled compressor, and those systems employing a capillary tube as a refrigerant expansion means. Also, certain "Hot Gas By-Pass Capacity Control Systems". In addition, applications of a special nature exist wherein the novel concepts of the present invention may be employed. Suction accumulator apparatus particularly well adapted for the noted applications is shown in FIG. 3, and reference is now made thereto.

The suction accumulator assembly of FIG. 3 is designated generally therein by the numeral 100, and comprises an outer substantially cylindrical shell or casing 102, the opposite ends of which mount cap or closure means 104 and 106, affixed by welding or other suitable techniques. Cap means 106 may support threaded mounting means 108, as is conventional in the art.

Supported in any suitable manner within the shell 102 is inner generally cylindrical shell or casing 110 mounting at opposite ends cap or closure means 112 and 114. The structural arrangement of shells 102 and 110 sealed at opposite ends define an air space 116 therein, whereby the apparatus as further described herein functions in the nature of a receiver. Shell 110 mounting cap means 112 and 114 at opposite ends thereof supports interiorly generally U-shaped outlet tube 118 provided with a relatively small metering opening **118*a*. Outlet tube 118 includes leg portions 118*b* and 118*c*, and positioned in proximity to leg portion 118*c* is inlet tube 120 supported by cap means 112. Shell 110, cap means 112 and 114, outlet tube 118, and inlet tube 120 structurally and functionally define a suction accumulator, designated generally by the numeral 122 in FIG. 3. As was indicated earlier in connection with the form of the invention shown in FIG. 2**, the novel concepts of the present invention are not limited to suction accumulators employing U-shaped outlet tubes. Exemplary of other suction accumulator construction is that shown in U.S. Pat. No. 5,167,128, as previously noted.

Referring now again to FIG. 3 of the drawings, leg portion 118*b* of outlet tube 118 is connected to first tubular portion 124 joined to second tubular portion 126 which connects with conduit means 14 leading to the compressor 12. As shown, in order to facilitate the connections described, leg portion 118*b* and first tubular portion 124 may be expanded as at 118*d* and 124*a*, respectively. First tubular portion 124 may be provided with an opening 124*b* to equalize the pressure in the leg portions 118*b* and 118*c* of the U-tube 118. Also, quill means 128 may be employed on the second tubular portion 126 to facilitate the connection to conduit means 14. Inlet tube 120 of suction accumulator 122 may be expanded at one end as at 120*a* for ease of connection with inlet tubular portion 130, which may mount quill means 131 to which is joined conduit means 24 leading to evaporator 22.

The suction accumulator assembly 100 of FIG. 3 as shown and thus far described, by provision of air space 116, is effective during operation to prevent sweating of suction accumulator 122, and subsequent rusting thereof. While under some operating conditions dead air space 116 provides adequate insulative properties, and clearly is superior to the prior art approach of wrapped fibrous insulation, efficiency of operation may be improved by evacuating air space 116. In the embodiment of the invention shown in FIG. 3, this is accomplished by provision of a relatively slender open-ended tubular member 136 supported by lower end cap 106 and located in opening 106a provided therein. As shown, tubular member 136 has access to air space 116, and after the requisite vacuum has been drawn, exposed end 136A is sealed in any suitable manner, as by crimping and solder application, or the like. Of course, tubular member 136 may be positioned at other locations on the suction accumulator assembly 100, in order to provide access to the air space 116. As earlier indicated with reference to FIG. 2, the air space 116 is evacuated to a condition in the space in which the pressure of the air is less than that of the normal atmosphere surrounding the vessel 110.

It was noted hereinabove that refrigeration systems are known wherein sweating of the suction accumulator presents problems, and yet the novel heat exchange characteristics described in connection with the form of the invention of FIG. 2 are not at all times required. Such systems may be exemplified by those using a suction cooled compressor, or those which employ a capillary tube as a refrigerant expansion means. Also, certain "Hot Gas By-Pass Capacity Control Systems". In addition, other special applications are known to the art wherein the invention exemplified by FIG. 3 is production of novel results.

Top end cap 104 is shaped in a manner to insure that sweating of the relatively cold inlet and outlet tubular members 130 and 126, respectively, does not occur. Cap or closure means 104 is formed with an annular flange portion 104*a* embracing the cylindrical outer shell 102 and a rounded shoulder portion 104*b* merging into a pair of upstanding or protruding tubular portions 132 and 134 connected by top wall portion 104*c*. The tubular portions 132 and 134 are shaped to include a relatively large diameter section 132*a* and 134*a*, respectively, and a reduced diameter neck section 132*b* and 134*b*, respectively. By reason of the uniquely contoured shape of the end cap 104, each of the tubular members 126 and 130 along a substantial portion of the length of each is surrounded by insulating space 137.

In fluid communication with the space 137 is a pair of tubular members 138 and 140 extending radially outwardly from end cap 104, generally at the location of the merger of the flange and shoulder portions 104*a* and 104*b* thereof. The tubular members 138 and 140 may of course communicate with the space 137 by being positioned at different locations. In order to maintain the space 137 at the desired temperature, tubular member 140 receives relatively hot refrigerant liquid or gas from a suitable source, which is discharged from tubular member 138 after performing a heat exchange function. Generally stated, the temperature of the liquid or gas entering the space 137 through the member 140 would typically be significantly above suction gas temperature.

We claim:

1. A suction accumulator assembly comprising:

a pair of casings one of which is positioned within the other and providing a first space therebetween sealed from an atmosphere surrounding the outer of said casings; a first inlet and outlet means extending through a wall of the inner of said casings causing said inner casing to serve as a suction accumulator;

a second inlet and outlet means supported by and extending through a wall of said outer casing and connected to said first inlet and outlet means, a portion of said second inlet and outlet means extending beyond an exterior of said outer casing; and a means on the exterior of said outer casing defining a second space surrounding said portion of said second inlet and outlet means and sealed from the atmosphere, said first space preventing sweating of said outer casing and said second space preventing sweating of said portion of said second inlet and outlet means.

2. A suction accumulator assembly according to claim 1 including means supported by said outer casing and communicating with said first and second spaces for evacuating said first and second spaces to near vacuum, whereby during operation of the suction accumulator assembly sweating of said outer casing and said portion of said second inlet and outlet means is prevented.

3. A suction accumulator assembly according to claim 1 including means communicating with said second space for flowing heated fluid therethrough.

4. A suction accumulator assembly according to claim 1 including means for sealing said first space from said second space.

5. A suction accumulator assembly according to claim 1 wherein said second inlet means is spaced from said second outlet means and said means for defining said second space is formed as separate annular spaces about said portion of each of said second inlet and outlet means.

6. A suction accumulator assembly comprising:

a pair of casings one of which is positioned within the other and providing a first space therebetween;

an inlet and outlet conduit means supported by said pair of casings and being in fluid communication between an interior of the inner of said casings and an exterior of the outer of said casings, whereby said inner casing functions as a suction accumulator;

a means on said exterior of said outer casing forming a second space through which said inlet and outlet conduits extend and being sealed from an atmosphere surrounding said outer casing and from said first space; and a means on said outer casing communicating with said second space for flowing heated fluid therethrough, whereby during operation of the suction accumulator assembly sweating of said outer casing and said portion of said inlet and outlet conduit means is prevented.

7. A suction accumulator assembly according to claim 6 including conduit means communicating with said first space for evacuating said first space to near vacuum, whereby during operation of the suction accumulator assembly sweating of said outer casing is effectively prevented.

8. A suction accumulator assembly according to claim 6 wherein said first and second conduit means includes first inlet and outlet means extending through a wall of said inner casing.

9. A suction accumulator assembly according to claim 8 wherein said first and second conduit means includes second inlet and outlet means supported by and extending through a wall of said outer casing and connected to said first inlet and outlet means, a portion of said second inlet and outlet means extending beyond said exterior of said outer casing through said second space, whereby during operation of the suction accumulator assembly sweating of said portion of said second inlet and outlet means is prevented.

10. A suction accumulator assembly comprising:

a pair of casings one of which is positioned within the other and providing a first space therebetween sealed from an atmosphere surrounding the outer of said casings;

a first inlet and outlet means extending through a wall of said inner casing;

a second inlet and outlet means supported by and extending through a wall of said outer casing and connected to said first inlet and outlet means, a portion of said second inlet and outlet means extending beyond said exterior of said outer casing;

a means on the exterior of said outer casing defining a second space surrounding said portion of said second inlet and outlet means and sealed from the atmosphere and from said first space; and a means on said outer casing communicating with said second space for flowing heated fluid therethrough, said first space preventing sweating of said outer casing and said second space preventing sweating of said portion of said second inlet and outlet means.

* * * * *